US006042438A

United States Patent [19]

Dean

[11] Patent Number: 6,042,438

[45] Date of Patent: Mar. 28, 2000

[54] ERGONOMIC CANOE PADDLE

[76] Inventor: W. Clark Dean, 43 Northgate, Simsbury, Conn. 06070

[21] Appl. No.: 09/271,560

[22] Filed: Mar. 18, 1999

[51] Int. Cl.[7] ..... B63H 16/04

[52] U.S. Cl. ..... 440/101; 416/74

[58] Field of Search ..... 16/110 R, DIG. 12; 440/101; 416/74; D12/215

[56] References Cited

U.S. PATENT DOCUMENTS

| | | | |
|---|---|---|---|
| D. 343,608 | 1/1994 | Nazara | D12/215 |
| 1,648,354 | 11/1927 | Lied | 16/110 R |
| 2,709,493 | 5/1955 | Hupp | 16/110 R |
| 3,324,490 | 6/1967 | Jewett | 9/25 |
| 3,330,245 | 7/1967 | Klabunde | 115/21 |
| 3,970,032 | 7/1976 | Phillips | 115/24.1 |
| 4,133,285 | 1/1979 | Phillips | 115/24.1 |
| 4,303,402 | 12/1981 | Gooding | 440/101 |
| 4,664,637 | 5/1987 | Loerch | 440/101 |
| 4,673,361 | 6/1987 | Harvey | 440/101 |
| 4,701,142 | 10/1987 | Merritt | 440/101 |

FOREIGN PATENT DOCUMENTS

| | | | |
|---|---|---|---|
| 749730 | 7/1980 | U.S.S.R. | 440/101 |
| 992320 | 2/1983 | U.S.S.R. | 440/101 |

*Primary Examiner*—Stephen Avila
*Attorney, Agent, or Firm*—Malcolm J. Chisholm, Jr.

[57] ABSTRACT

The invention is an ergonomic canoe paddle. The paddle includes a shaft having a shear side and an opposed drag side, a blade having a shear surface and an opposed drag surface, wherein the blade is secured to a bottom end of the shaft so that the shear surface of the blade is secured to the shear side of the shaft and the drag surface of the blade is secured to the drag side of the shaft, and a handle secured to a top end of the shaft. The handle includes a central grip bar secured to the top end of the shaft, a right grip stem and a left grip stem secured to opposed ends of the grip bar. The right and left grip stems extend away from the shaft in a direction that is both about twenty degrees from a plane perpendicular to a longitudinal axis of the shaft, and that is also away from the drag side of the shaft about sixty-five degrees from a plane roughly parallel to the shear surface of the blade. The right and left grip stems are dimensioned to receive a user's grip so that when a user wraps a hand around either right or left grip stem, the blade is disposed in an angular alignment that compensates for non-linear thrust of the paddle as the shear surface of the blade shears water to propel a canoe through the water.

16 Claims, 5 Drawing Sheets

ERGONOMIC CANOE PADDLE

BACKGROUND OF THE INVENTION

The present invention relates to hand-held apparatus for propelling light watercraft, such as paddles for moving canoes through water.

Conventional canoe paddles include a straight shaft having typically a "T"-shaped hand grip at the top end of the shaft, and a blade secured to a lower end of the shaft, wherein an elongate grip portion of the "T"-shaped hand grip extends in both perpendicular alignment with the shaft, and in parallel alignment with a plane defined by a flat surface of the blade, meaning a surface of the blade extending between side edges of the blade. It is well known that in use of such a conventional paddle to propel a canoe through water by a single user, the user kneels or sits in a rear or stern section of the canoe and places the blade of the paddle into the water so that the flat surface of the blade is perpendicular to a desired or forward direction of travel. The user holds the "T"-shaped hand grip of the paddle in one hand, and a lower-mid section of the shaft in the other hand. For example, if the user places the paddle on a right side of the canoe looking forward from the stern (e.g., the starboard side), the left hand of the user will be on the hand grip of the shaft, and the right hand will be on the lower-mid section of the shaft. The user then pulls the paddle toward the rear of the canoe through a stroke, causing the canoe to move forward in a conventional manner. When the user's arms can reach no further backward, the paddle is removed from the water, brought forward again, placed in the water for another stroke.

Because such strokes of a conventional canoe paddle are not aligned with a center of drag of the canoe, the canoe tends to turn in a direction that is opposite the side beyond which the paddle is stroked. If the paddle is moved through a stroke on the starboard side, the canoe will turn to the opposite, or port side. One common approach to counter that non-linear thrust characteristic of conventional straight canoe paddles is to frequently switch the paddle from the starboard to port side of the canoe after several strokes, and back and forth in a repetitious manner to move the canoe in a twisting, yet overall straight direction. Another and perhaps more common approach is the well-known "J-stroke". In executing a J-stroke, as shown in FIG. 5, as the paddle nears the end of the stroke wherein the user's arms can reach no further toward the stern of the canoe, the user rotates the paddle so that the flat surface of the blade, while still underwater, is aligned parallel to the direction of travel of the canoe. The user then pushes the blade away from the canoe before the blade is extracted from the water, thereby generating a counter turning force to the non-linear thrust of the conventional straight shaft canoe paddle.

While either switching from side-to-side or use of a J-stroke effectively moves the canoe in a straight direction, both techniques have substantial disadvantages. Switching from side-to-side requires additional energy, typically causes water to drip into the canoe as the paddle passes over the canoe, and enhances a risk of dropping the paddle. Use of the J-stroke also requires use of energy of the user in pushing the paddle blade away transverse to the direction of travel of the canoe, which causes a slight drag effect, slowing the canoe. Even worse, the J-stroke requires twisting of the user's wrists, and application of force through the wrists when twisted. Such repeated, stressful stretching of the wrists gives rise to a risk of repetitive motion trauma. Additionally, the outward movement of the user's arm away from the canoe is an awkward and therefore tiring motion.

An additional drawback of conventional straight shaft canoe paddles is an inefficient use of the paddle through a full length of a stroke from paddle insertion into the water to paddle extraction. Because the shaft is straight, the ability of the user to extend the blade forward, beyond the knees of a seated user, is limited by flexibility of the user's wrist on the arm grabbing the lower-mid shaft. As seen in FIG. 7, the blade cannot extend much further than the user's knees because of limitations in flexing the wrist of the user's pulling arm toward the user's shoulder. Consequently, the blade of the conventional paddle enters the water at a near vertical position relative to a surface of the water, and leaves the water at a position wherein the blade is almost parallel with the surface of the water. Therefore, the flat surface of the blade is roughly perpendicular to the direction of travel and the surface of the water for only a small portion of the full length of the paddle stroke from paddle insertion to extraction. For a substantial portion of the length of the stroke, the flat surface is moving to become parallel to the surface of the water, so that the user is expending energy to pull the paddle up toward the surface, rather than backward, to move the canoe forward.

Additionally, a portion of the full length of the paddle stroke wherein the user can most efficiently exert force on the paddle to move the blade toward the rear of the canoe is also only a small portion of the full length of the paddle stroke. In other words, while the user's arms are extended well in front of the user's shoulders, the user can exert substantially more force on the paddle than when the user's arms are closed into and near the user's chest and shoulders. However, as seen in FIG. 7, the blade of a conventional paddle is efficiently disposed in the water for only a small portion of the full length of the paddle stroke while the user's arms are forward of the user's shoulders. Therefore, conventional straight shaft paddles are inherently unable to take efficient advantage of a full length of a paddle stroke. If a second user in a front or bow of the canoe is simultaneously using a paddle on the opposite side of the canoe, some of the offset thrust of the stern user is compensated for, but the stern user must still use the J-stroke or other means to maintain straight travel.

Many solutions have been developed to resolve the conventional straight shaft paddle problems of both inefficient blade positioning through a full stroke length and also the non-linear thrust characteristics of such paddles. No paddle designed to solve both of those problems has to date become popular or widely used. A variety of bent shaft paddles are known that enable a user to place the blade in the water further forward of the user's knees, and some of these result in a more efficient use of the blade through the full length of the stroke. However, such bent shaft paddles give rise to a variety of problems related to the bent shaft. For example, in "back-paddling", for control of a canoe during steering, accurate positioning, docking, or landing, etc., use of bent shaft paddles results in substantial torsional or twisting loads on the shaft, which must be controlled by the user's wrists. Such torsional loads are difficult in flat water canoeing, and may be crucial in white water canoeing. Additionally, bent shaft paddles are also susceptible to greater torsion loads upon extraction and insertion of the paddle blade into the water than are straight shaft paddles, which loads must be compensated for by the user's wrists. Such bent shaft paddles do not change the non-linear thrust characteristics of conventional paddles.

One solution to the non-linear thrust characteristics of canoe paddles is shown in U.S. Pat. No. 3,970,032 issued on Jul. 20, 1976 to Phillips which shows a spring-biased, quick release locking assembly within the shaft, between a handle and blade of the paddle. The quick release locking assembly allows a user to pull the handle a short distance and rotate it so that a major axis of a grip member of the handle "may selectively be angularly aligned with and disaligned with a plane of the blade member". The blade may then enter the water at an angle offset to a plane perpendicular to a desired direction of travel. By pulling the offset blade toward the rear of the canoe, a counter turn pressure is generated tending to make the canoe move in a straight line. While the offset blade angle of Phillips solves some of the non-linear thrust problem of conventional paddles, it has not become popular for many reasons. First, the spring-biased quick release locking assembly is complicated, delicate, and exposed to extremely harsh, wet environments of outdoor water sports, and therefore has reliability problems. Second, to use the paddle on one side of the canoe and then on the other (as is done even if moving straight ahead to avoid asymmetric muscle use and fatigue, etc.) the user must pull the handle against spring pressure and re-set the angle of the grip member relative to the blade for opposed side usage, while traveling in the canoe, which is a challenge to comfortable balance, and also presents a risk of dropping the paddle. Third, while the offset angle of the blade to the grip member generates a counter turning force, that force is a result of the user's arms resisting a tendency of the paddle to slip into the canoe, toward the user. Resisting that slipping or lateral motion of the blade force requires a twisting or torsional force that must be applied by the user's wrists, which tires the wrists, especially during long, flat water passages.

Accordingly, known bent shaft paddles and off-set blade to grip member paddles have not solved common, well-known canoe paddle problems. Therefore it is a goal of the present ergonomic canoe paddle to provide a paddle that compensates for non-linear thrust, and that also enhances efficient blade movement through a full paddle stroke length.

SUMMARY OF THE INVENTION

An ergonomic canoe paddle is disclosed for propelling a canoe through water. The paddle includes a shaft having a shear side and an opposed drag side, a blade having a shear surface and an opposed drag surface, wherein the blade is secured to a bottom end of the shaft so that the shear surface of the blade is secured to the shear side of the shaft and the drag surface of the blade is secured to the drag side of the shaft, and a handle secured to a top end of the shaft. The handle includes a central grip bar secured to the top end of the shaft in perpendicular disposition to a longitudinal axis of the shaft, a right grip stem and a left grip stem secured to opposed ends of the grip bar and extending away from the shaft in a direction that is both about twenty degrees from a plane perpendicular to the longitudinal axis of the shaft, and that is also away from the drag side of the shaft about sixty-five degrees from a plane defined as extending between opposed left and right edges of the blade and the top end of the shaft. The right and left grip stems are dimensioned to receive a user's grip so that when a user wraps a hand around either right or left grip stem, the blade is disposed in an angular alignment that compensates for non-linear thrust.

For example, if the user is paddling on the right or starboard side of the canoe, the user grabs the right grip stem with a left hand, grabs the shaft with the right hand and then pulls the paddle through a paddle stroke causing the shear surface of the blade to face a rear end of the canoe and move in the water toward the rear end of the canoe. By grabbing the right grip stem in an ergonomically comfortable position with no bending of the left wrist, the left edge of the blade is positioned closer to the rear end of the canoe than the right edge of the blade. Therefore, as the blade is moved toward the rear of the canoe, the tendency of the blade to slide toward the canoe imparts both a lateral and a torsional force on the shaft which forces are compensated for by the user resisting those lateral and torsional or twisting forces through applying modest force to the right grip stem and shaft. Because the right grip stem extends beyond the longitudinal or pivot axis of the shaft, the user receives a mechanical advantage in resisting the lateral and torsional force caused by the angular alignment of the blade being non-perpendicular to the direction of the pulling force of the user and of the desired direction of travel. When the user desires to use the ergonomic canoe paddle on the opposed side, the user simply places a right hand on the left grip stem and a left hand on the shaft. The blade is thereby positioned in an angular alignment to compensate for non-linear thrust while using the paddle on the opposed side.

In a preferred embodiment, the shaft includes an upper shaft segment, a lower shaft segment, and a grip strut dimensioned to receive a user's grip, that is positioned between the lower shaft segment the upper shaft segment, wherein the upper shaft segment, grip strut and lower shaft segment are in non-linear alignment so that the grip strut extends away from the drag side of the upper shaft segment, and the lower shaft segment extends away from the shear side of the upper shaft segment to position the blade away from the shear side of the upper shaft segment and grip stems. By positioning the grip strut away from the drag side of the upper shaft segment, the user may grab the shaft without bending a wrist while positioning the blade in the water to enhance efficiency of the paddle stroke. By positioning the blade away from the shear side of the upper shaft segment, the blade enters the water closer to the front of the canoe than if the shaft were straight, thereby enhancing efficiencies of the paddle stroke through the water. In addition, by use of the grip stems being positioned as described above, about sixty-five degrees away from the drag side of the shaft, and by the blade being positioned away from the shear side of the upper shaft segment, the grip stems and non-linear shaft cooperate so that the blade passes through the water closer to a center of drag of the canoe, thereby further compensating for non-linear thrust of the paddle.

Accordingly, it is a general object of the present invention to provide an ergonomic canoe paddle that overcomes the deficiencies of prior art paddles.

It is a more specific object to provide an ergonomic canoe paddle that compensates for non-linear thrust of canoe paddles.

It is yet another object to provide an ergonomic canoe paddle that facilitates efficient positioning of the paddle through a full length of a paddle stroke.

It is a further object to provide an ergonomic canoe paddle that compensates for non-linear thrust and facilitates efficient positioning of the paddle through a full length of a paddle stroke, while minimizing bending of a users's wrists It is another specific object to provide and ergonomic canoe paddle that compensates for non-linear thrust during usage on either side of a canoe with no adjustments to the paddle.

These and other objects and advantages of this invention will become more readily apparent when the following description is read in conjunction with the accompanying drawings.

DESCRIPTION OF THE PREFERRED EMBODIMENTS

Figure 1:
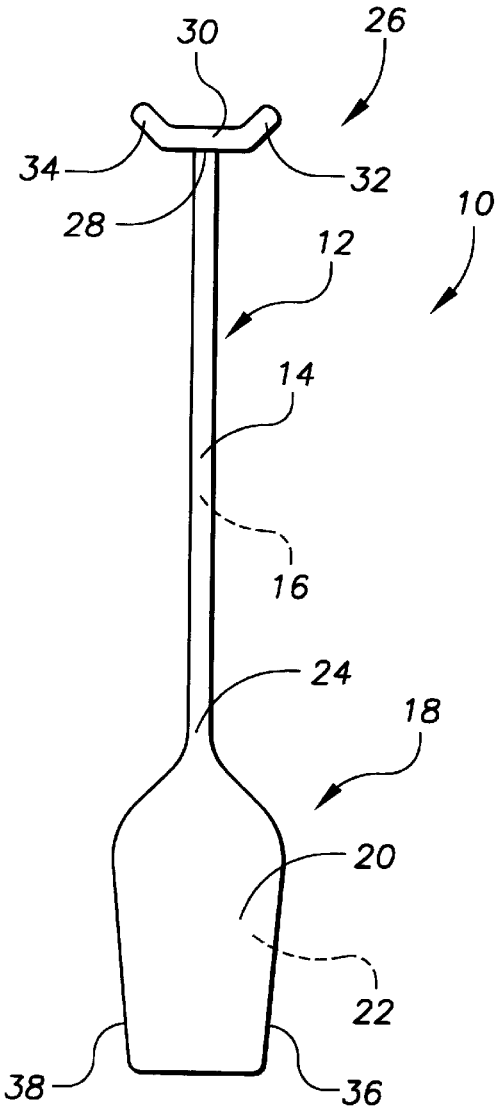
FIG. 1 is a front plan of a ergonomic canoe paddle constructed in accordance with the present invention.

Referring to the drawings in detail, an ergonomic canoe paddle of the present invention is shown in FIG. 1, and generally designated by the reference numeral 10. The ergonomic canoe paddle 10 includes a shaft 12 having a shear side 14 and an opposed drag side 16; a blade 18 having a shear surface 20 and an opposed drag surface 22 secured to a bottom end 24 of the shaft 12 so that the shear surface 20 of the blade 18 is secured to the shear side 14 of the shaft and the drag surface 22 is secured to the drag side 16 of the shaft 12; and a handle 26 secured to a top end 28 of the shaft, wherein the handle includes a central grip bar 30 secured to a top end 28 of the shaft in perpendicular disposition to a longitudinal axis of the shaft 12, a right grip stem 32 and a left grip stem 34 secured to opposed ends of the grip bar 30. As best seen in the representation of the handle 26 in FIGS. 2 and 3, the right and left grip stems 32, 34 extend away from the shaft 12 in a direction that is both about twenty degrees from a plane perpendicular to the longitudinal axis of the shaft 12 adjacent the top end 28 of the shaft and that is also in a direction that is away from the drag side 16 of the shaft 12 about twenty degrees to about seventy-five degrees or preferably about sixty-five degrees from a plane defined as extending between opposed right 36 and left 38 edges of the blade 18 and the top end 28 of the shaft. For ease of understanding, the plane perpendicular to the longitudinal axis of the shaft is schematically represented in cross-section by the hatched line "A—A" in FIG. 2, wherein the about twenty degree direction of extension of the right and left grip stems 32, 34 is shown by the reference numeral 40. Similarly, the plane defined as extending between opposed right 36 and left 38 edges of the blade 18 and the top end 28 of the shaft 12 is schematically represented in cross-section by the hatched line "B—B" in FIG. 3, wherein the about sixty-five degrees extension of the right and left grip stems 32, 34 is shown by the reference numeral 42. The central grip bar 30 that is secured in perpendicular disposition to the longitudinal axis of the shaft 12 may also be secured so that it is in parallel alignment with the plane defined as extending between the right 36 and left 38 edges of the blade 18 and the top end of the shaft 12.

For purposes of clarity, whenever the phrase "away from" is used herein, such as "the right and left grip stems 32, 34 extend away from the shaft 12", it is meant that the object being described as extending "away from" defines an axis having a beginning point and end point, wherein the end point is further from the subject to which reference is made than the beginning point. For example, the right and left grip stems 32, 34 each include beginning points of securement to the opposed ends of the central grip bar 30. By describing the right and left grip stems as "extending away from the shaft 12 . . . and also in a direction that is away from the drag side 16 of the shaft 12", it is meant to define end points of the right and left grip stems as further from both the shaft 12 and drag side 16 of the shaft 12 than the beginning points of the right and left grip stems 32, 34.

Figure 2:
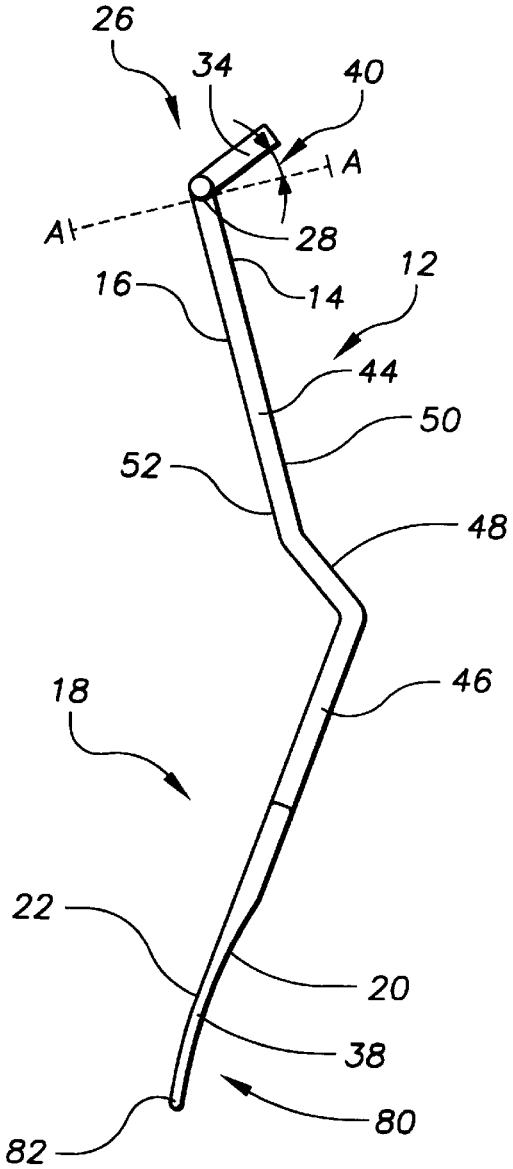
FIG. 2 is a side plan view of a first alternative embodiment of an ergonomic canoe paddle constructed in accordance with the present invention.
Figure 3:
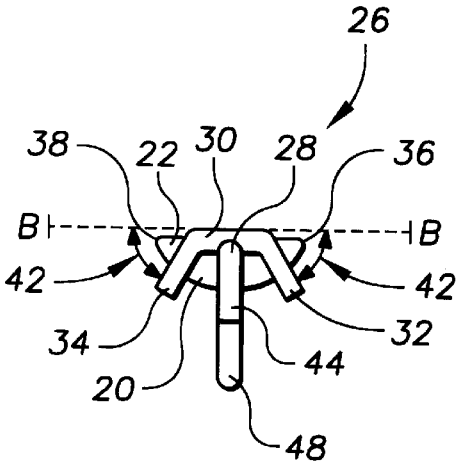
FIG. 3 is a top plan view of the FIG. 2 ergonomic canoe paddle.

As seen in FIG. 2, in a first alternative embodiment of the ergonomic canoe paddle 10, the shaft 12 includes an upper shaft segment 44, a lower shaft segment 46 and a grip strut 48 secured between the upper and lower shaft segments 44, 46, wherein the upper shaft segment 44, grip strut 48 and lower shaft segment 46 are secured in non-linear alignment. The upper shaft segment includes a shear side 50 and an opposed drag side 52, and the shear side 50 of the upper shaft segment is secured to the shear side 14 of the shaft 12 adjacent the top end of the shaft 12 and the drag side 52 of the upper shaft segment is secured to the drag side 16 of the shaft 12 adjacent the top end 28 of the shaft 12. The grip strut 48 extends from the upper shaft segment 44 in a direction that is away from the drag side 52 of the upper shaft segment 44 and that is about one-hundred and fifty degrees from a longitudinal axis of the upper shaft segment 44. The lower shaft segment 46 extends from the grip strut 48 in a direction that is away from the shear side of the upper shaft segment and that is about one-hundred and fifty degrees from the longitudinal axis of the upper shaft segment 44, as shown best in FIG. 2. A second alternative embodiment shown in FIG. 4 may also include an upper shaft grip support extension 54 that serves to support the grip strut 48 as the paddle 12 is pulled by the grip strut 48 through water. The upper shaft grip extension 54 extends between the upper and lower shaft segments 44, 46 and is in about parallel alignment with the longitudinal axis of the upper shaft segment 44, thereby forming a triangular support structure between the grip strut 48, lower shaft segment 46 and upper shaft grip extension 54.

Figure 5:
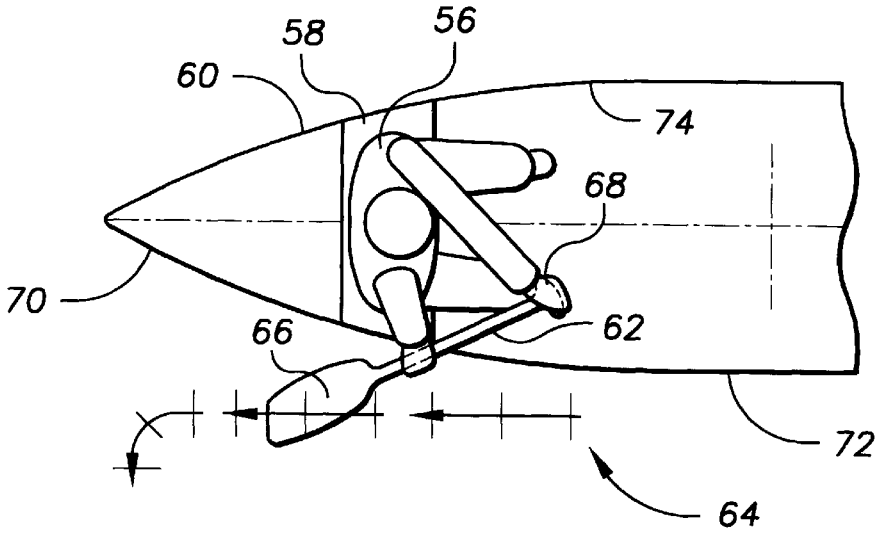
FIG.5 PRIOR ART
FIG. 5 is a fragmentary top plan view of a user of a prior art canoe paddle showing the user demonstrating a J-stroke.

Advantages of use of the ergonomic canoe paddle 10 of the present invention are demonstrated FIGS. 5–10. In FIG. 5, a user 56 is shown in top view seated on a stern seat 56 of a canoe 58 using a prior art, conventional straight shaft canoe paddle 62. A first schematic arrow and line pattern 64 shows in broken lines the angular position of a prior art blade 66 as the user pulls the prior art paddle through a stroke wherein the stroke direction is represented by the arrow of the pattern 64. As the user moves the prior art paddle 62 through the stroke, the blade 66 must be twisted to turn from being perpendicular to an intended direction of travel of the canoe to being parallel to that direction, and then the user 56 pushes the blade away from the canoe, as shown by the arrow of the pattern 64 to counter non-linear thrust of the canoe, thereby executing a well-known "J"-stroke. It is stressed that a left wrist 68 of the user that holds the prior art paddle 62 must be twisted in an uncomfortable and tiring position during execution of the "J"-stroke.

Figure 6:
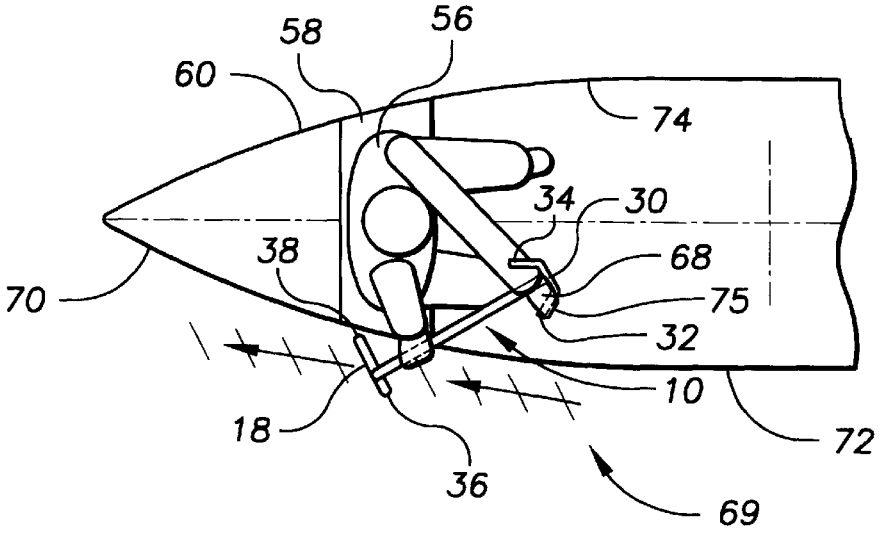
FIG. 6 is a fragmentary top plan view of a user of the an ergonomic canoe paddle of the present invention.

In contrast, use of the ergonomic canoe paddle 10 of the present invention, as shown in FIG. 6, eliminates any need for executing a tiring, uncomfortable "J"-stroke. As shown in FIG. 6 in a second schematic line and arrow pattern 69, by the user simply positioning the left wrist 68 in a straight position on the right grip stem 32, the blade is automatically positioned to compensate for non-linear thrust when the user simply pulls the paddle in a straight line toward a rear 70 of the canoe. In particular, by the fixed alignment of the right grip stem 32 relative to the plane defined as extending between right and left edges 36, 38 of the blade and the top end 28 of the shaft 12, when the user is paddling over the starboard side 72 of the canoe 60, the left edge 38 of the blade 18 is positioned closer to the rear 70 of the canoe 60 than is the right edge 36. Because the blade 18 is not perpendicular to the direction of the stroke of the user, as represented by the lines and arrow in the second pattern 69, the blade 18 and shaft 12 tend to slide toward the canoe 60. By the user compensating for that sliding force in keeping the paddle in a straight stroke, a counter force is established to keep the canoe travelling in a straight line. Resistance by the user 56 to that sliding or any torsional force is substantially assisted by the positioning of the right stem 32 at an angle that allows the user 56 to use the left wrist 68 without bending or twisting, and also by the grip stems 32, 34 being positioned beyond the longitudinal or pivot axis of the shaft, so that the user receives a mechanical advantage in countering the lateral and any torsional forces generated by the blade 18 slipping toward the canoe 60. When the user desires to use the ergonomic paddle on the opposed or port side 74 of the canoe 60, simply grabbing the left grip stem 34 with the user's 56 other wrist will automatically position the blade 18 to be in an angular alignment (not shown) to compensate for non-linear force generated by paddling over the port side 74 of the canoe 60. It is also apparent from FIG. 6 that the right and left grip stems 32, 34 are dimensioned to receive the user's upper hand grip 75.

Figure 7:
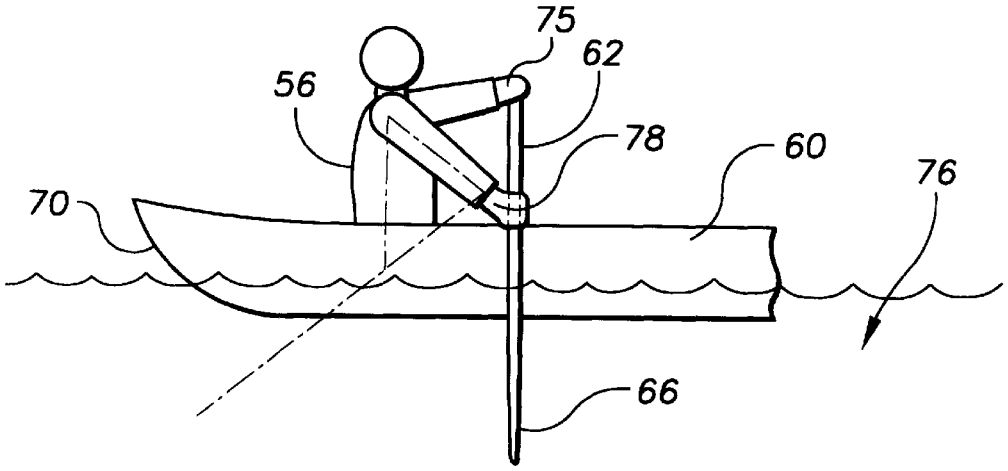
FIG. 7 PRIOR ART
FIG. 7 is a fragmentary side plan view of a user of a prior art straight shaft canoe paddle.

FIG. 7 shows a side view of the user 56 moving the prior art straight shaft canoe paddle 62 from a beginning of a stroke where the prior art paddle 62 is inserted into water 76 to where the paddle 62 finishes the stroke (shown schematically in hatched lines). As can be seen, the right wrist 78 must be twisted in an upward direction, away from the water 76 effectively limiting a distance forward of the user 56 that the paddle 62 may be inserted into the water 76. The stroke of such a paddle 62 through the water therefore has a limited distance through which the blade 66 may be efficiently pulled.

Figure 8:
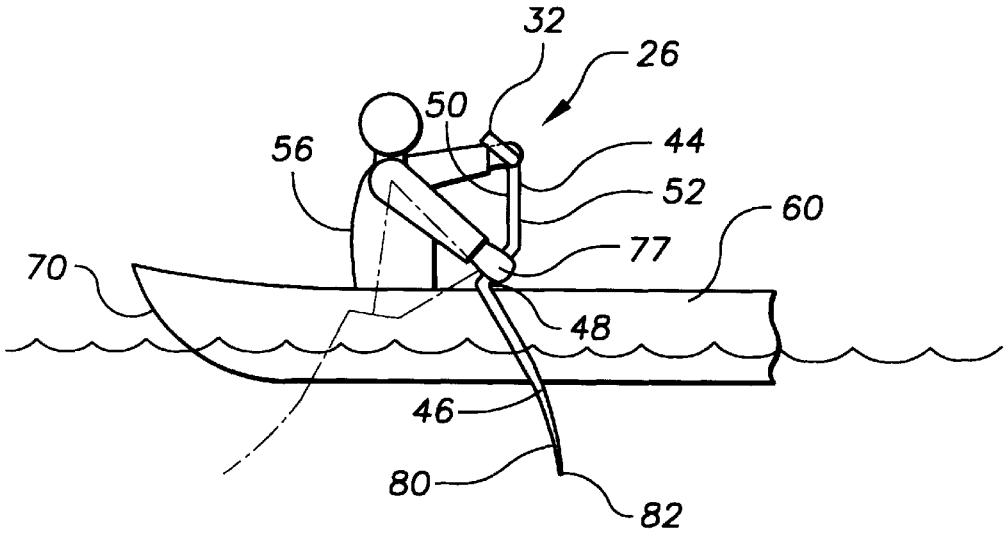
FIG. 8 is a fragmentary side plan view of a user of the FIG. 2 ergonomic canoe paddle of the present invention.

In contrast, as shown in FIG. 8, the first alternative embodiment of the ergonomic canoe paddle 10 of the present invention substantially enhances both the distance through which the blade 18 may be efficiently pulled, and also enables the right wrist 78 of the user 56 to not have to be twisted in order to pull the blade 18 through that enhanced distance. As seen in FIG. 8, the grip strut 48 is dimensioned to receive the user's lower hand grip 77. Because the lower shaft segment 46 extends away from the shear side 50 the upper shaft segment 44, the lower shaft segment extends forward of the user 56, away from the rear of the canoe 70. That disposition of the lower shaft segment 46 relative to the upper shaft segment 44 enables the blade 18 to be inserted into the water 76 well forward of the user 56, so that movement of the blade 18 through the paddle stroke is in a much more efficient position than the prior art straight shaft paddle 62.

By use of the terms "shear side" and "drag side", it is meant that, during use of the ergonomic paddle 10 to propel a canoe or similar water craft forward, the blade 18 of the paddle 10 will be pulled in a direction opposite the intended direction of travel. Therefore the shear surface 20 of the blade 18 of the paddle 10 will be facing the rear of the canoe and shearing the water 76, while the opposed drag surface 22 of the blade 18 will be dragged along within the sheared water. The same axes of orientation are used herein with respect to the shear side 14 and drag side 16 of the shaft 12, and the shear side 50 and drag side 52 of the upper shaft segment 44 of the shaft 12 in order to describe dispositions of the components of the ergonomic canoe paddle 10 relative to each other. The shear side 14 of the shaft 12, and the shear side 50 of the upper shaft segment 44 of the shaft 12 are on the same side of the paddle 10 as the shear surface 20 of the blade 18.

Figure 4:
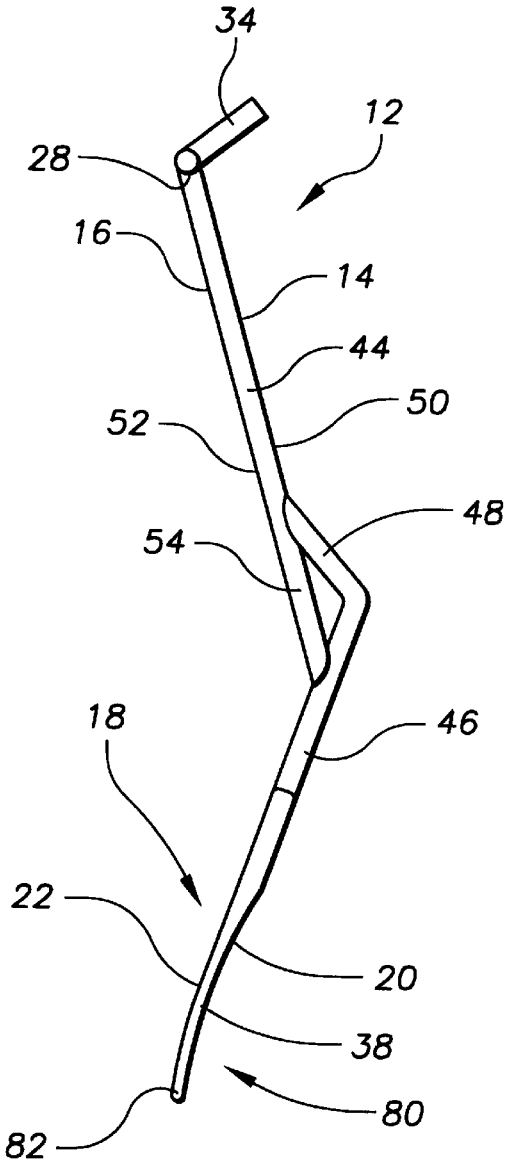
FIG. 4 is a side plan view of a second alternative embodiment of an ergonomic canoe paddle constructed in accordance with the present invention.

The ergonomic canoe paddle 10 also may include a slight curvature 80 of the blade 18, as seen best in FIGS. 2, 4, and 8. The curvature 80 includes a gently curved tip end 82 of the blade 18 extending away from the drag surface 22 of the blade. Because of the positioning of the right and left grip stems 32, 34 in the FIG. 1 ergonomic canoe paddle 10, and, as can be readily seen in FIG. 8, because of the grip strut 48 as described above with respect to the upper and lower shaft segments 44, 46 in the first alternative embodiment of the paddle 10, during usage the paddle 10 will be automatically positioned to have the curvature 80 properly positioned so that the tip end 82 of the blade 18 is closer to the rear 70 of the canoe than the shear surface of the blade 18. With known prior art canoe paddles, adding curvature to a blade is known to improve efficiency of a stroke, however it is easy for the user 56 to improperly position such a curvature of straight shaft paddles so that the curvature faces away from the rear of the canoe. Such and improper position decreases resistance to movement of the paddle through the water and thereby decreases efficiency of the stroke. Such an incorrect positioning of the curvature 80 is impossible with the ergonomic canoe paddle 10.

Figure 9:
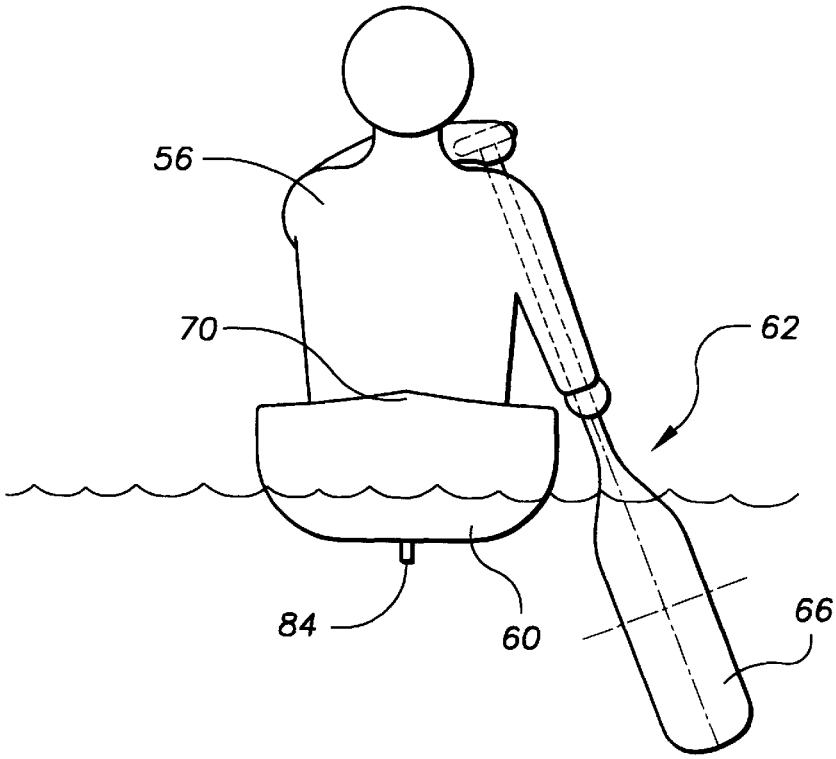
FIG. 9 PRIOR ART
FIG. 9 is a rear plan view of a user of a prior art canoe straight shaft canoe paddle.
Figure 10:
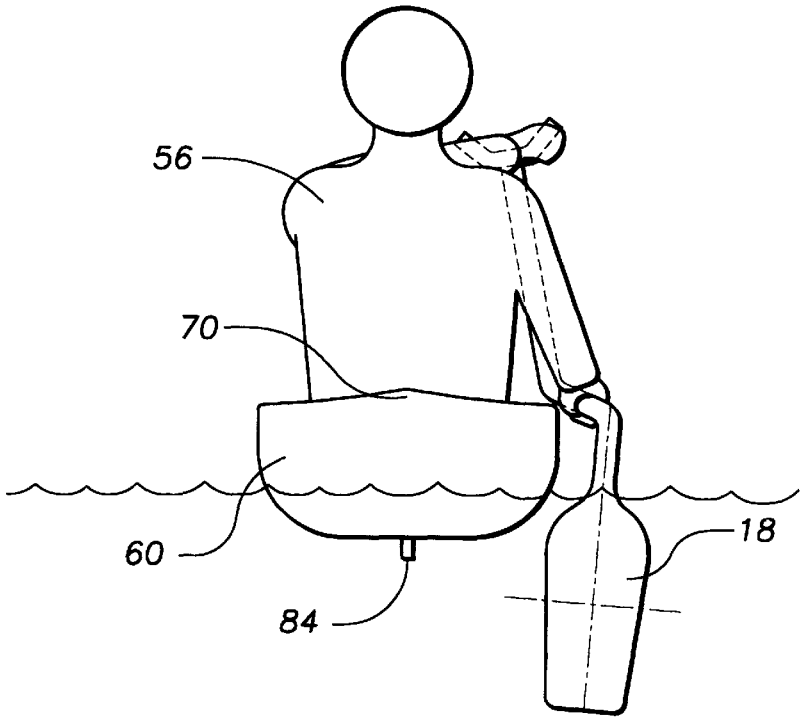
FIG. 10 is a rear plan view of a user of an ergonomic canoe paddle of the present invention.

FIG. 9 is a rear view of the user 56 paddling the canoe 60 with a prior art straight shaft canoe paddle 62 through the water. As is apparent, the blade 66 of the paddle 62 extends away from a center of drag of the canoe 62, such as a keel 84, at a continuous angle defined by the relative positions of the user's left and right wrists 68, 78 because the prior art paddle is a straight shaft paddle. In contrast, and as shown in FIG. 10, because the first and second alternative embodiments of the ergonomic canoe paddle of the present invention include the upper shaft segment 44, grip strut 48 and lower shaft segment 46 being in the non-linear alignment described above, and because the right and left grip stems 32, 34 extend away from the longitudinal axis of the shaft 12 as described above, the blade 18 of the paddle 10 rotates in toward the center of drag or keel 84. Because the blade 18 is closer to the center of drag, the non-linear force exerted on the canoe is less than a similar force exerted further from the center of drag. Therefore, the positioning of the blade 18 away from the shear side 50 of the upper shaft segment 44, and the positioning of the grip stems 32, 34 about sixty-five degrees away from a plane defined as passing through the right and left edges 36, 38 and top end 28 of the shaft (hatched line "B—B" in FIG. 3), cooperate to further compensate for non-linear thrust of the ergonomic canoe paddle 10. It is stressed that "angular positioning" of prior art bent shaft blades to mimic the angular position of the blade of the present ergonomic canoe paddle 10 could also move the blade closer to the center of drag of a canoe. However, any such effort at alignment and positioning would necessarily result in greater lateral and torsional or twisting forces on the shaft, which would require greater, tiring efforts on the part of the user to maintain consistent positioning of such a bent shaft paddle alignment. In contrast, because the right and left grip stems 32, 34 of the handle 26 of the ergonomic canoe paddle 10 extend away from the longitudinal or pivot axis of the shaft 12, the user receives a substantial mechanical advantage in resisting such lateral and any torsional or twisting forces acting on the shaft 12.

The ergonomic canoe paddle 10 may be fabricated out of any materials commonly known to provide durable hand-held apparatus for propelling light watercraft, such as modern polymeric materials, metal alloys, or hollowed out, laminated hardwoods, etc. In use of the ergonomic canoe paddle 10 having a shaft 12 without the non-linear alignment of upper and lower shaft segments 44, 46 and a grip strut 48 as shown in FIG. 1, the above described positioning of the right and left grip stems 32, 34 of the handle 26 relative to the angular disposition of the shear surface of the blade 18 and the drag side of the shaft, achieves automatic, substantial compensation for non-linear thrust of the paddle 10, and provides an ergonomically comfortable hand grip for the user in both the right and left grip stems 32, 34 which also afford enhanced control of the paddle. It is also pointed out that the central grip bar 30, like the right and left grip stems 32, 24, is dimensioned to receive a user's hand grip. For example, if the user needs stability of the blade 18 during back-paddling, or desires to take a rest from resisting the lateral or slipping forces described above resulting from the relative positions of the grip stems 32, 34 and shear surface 20 of the blade 18, the user 56 simply grabs the central grip bar 30 instead of the right or left grip stem 32, 34. The center grip bar 30 is also a preferred grip area for a second user positioned in the a front or bow section of the canoe 60 because no compensating lateral force is needed by the bow user. When the ergonomic canoe paddle 10 also includes a shaft 12 having the above described non-linear alignment of upper and lower shaft segments 44, 46 and a grip strut 48 shown in FIGS. 2, 3, 4, 6, 8, and 10, the paddle 10 achieves even further compensation for non-linear thrust by positioning the blade closer to the center of drag of the canoe 12, and also enhances efficiency of the paddle 10 stroke through the water by positioning the blade 18 further forward of the user 56, and finally also provides an ergonomically comfortable hand grip on the grip strut 48.

While the present invention has been described and illustrated with respect to a particular construction of an ergonomic canoe paddle 10, it will be understood by those skilled in the art that the present invention is not limited to the above described examples and embodiments. For example, the central grip bar 30 and right and left grip stems 32, 34 are illustrated as generally straight. However, the handle 26 could be generally "U" shaped, wherein the central grip bar 30 is slightly curved and the right and left grip stems 32, 34 are formed in a manner to enhance comfort of gripping, economy of manufacture, or efficiency of usage. Accordingly, reference should be made primarily to the attached claims rather than to the foregoing specification to determine the scope of the invention.

What is claimed is:

1. An ergonomic canoe paddle for propelling a light watercraft through water, comprising:

a. a shaft having a shear side and an opposed drag side;

b. a blade having a shear surface and an opposed drag surface secured to a bottom end of the shaft, so that the shear surface of the blade is secured to the shear side of the shaft and the drag surface of the blade is secured to the drag side of the shaft; and, c. a handle secured to a top end of the shaft, the handle including a central grip bar secured to the top end of the shaft, a right grip stem and a left grip stem secured to opposed ends of the central grip bar, wherein the right and left grip stems extend in a direction that is both away from the shaft and that is also away from the drag side of the shaft about twenty degrees to about seventy-five degrees from a plane defined as extending between opposed right and left edges of the blade and the top end of the shaft, so that when the left or right grip stem receives a user's hand grip the shear surface of the blade is disposed in an angular alignment that compensates for non-linear thrust as the shear surface of the blade shears the water to propel the watercraft.

2. The ergonomic canoe paddle of claim 1, wherein the right and left grip stems extend away from the shaft in a direction that is both about twenty degrees from a plane perpendicular to a longitudinal axis of the shaft adjacent the top end of the shaft and that is also in a direction that is about sixty-five degrees from the plane extending between opposed right and left edges of the blade and the top end of the shaft.

3. The ergonomic canoe paddle of claim 1, wherein the shaft includes an upper shaft segment, a lower shaft segment, and a grip strut dimensioned to receive a user's hand grip secured between the upper and lower shaft segments; the upper shaft segment includes a shear side secured to the shear side of the shaft adjacent the top end of the shaft and the upper shaft segment includes a drag side secured to the drag side of the shaft adjacent the top end of the shaft; and, the grip strut extends from the upper shaft segment in a direction that is away from the drag side of the upper shaft segment and the lower shaft segment extends from the grip strut in a direction that is away from the shear side of the upper shaft segment.

4. The ergonomic canoe paddle of claim 3, wherein the grip strut extends in a direction that is away from the drag side of the upper shaft segment and that is about one-hundred and fifty degrees from a longitudinal axis of the upper shaft segment, and the lower shaft segment extends from the grip strut in a direction that is away from the shear side of the upper shaft segment and that is about one-hundred and fifty degrees from the longitudinal axis of the upper shaft segment.

5. The ergonomic canoe paddle of claim 1, wherein the blade includes a slight curvature so that a tip of the blade extends in a direction away from the drag surface of the blade.

6. An ergonomic canoe paddle for propelling a light watercraft through water, comprising:

a. a shaft having a shear side and an opposed drag side, the shaft including an upper shaft segment, a lower shaft segment, and a grip strut dimensioned to receive a user's hand grip secured between the upper and lower shaft segments, wherein the upper shaft segment, grip strut and lower shaft segment are secured in non-linear alignment;

b. a blade having a shear surface and an opposed drag surface secured to a bottom end of the shaft, so that the shear surface of the blade is secured to the shear side of the shaft and the drag surface of the blade is secured to the drag side of the shaft; and, c. a handle secured to a top end of the shaft, the handle including a central grip bar secured to the top end of the shaft, a right grip stem and a left grip stem secured to opposed ends of the central grip bar, wherein the right and left grip stems extend in a direction that is both away from the shaft and that is also away from the drag side of the shaft about fifty degrees to about seventy degrees from a plane defined as extending between opposed right and left edges of the blade and the top end of the shaft, so that when the left or right grip stem receives a user's hand grip the shear surface of the blade is disposed in an angular alignment that compensates for non-linear thrust as the shear surface of the blade shears the water to propel the watercraft.

7. The ergonomic canoe paddle of claim 6, wherein the upper shaft segment includes a shear side secured to the shear side of the shaft adjacent the top end of the shaft and the upper shaft segment includes a drag side secured to the drag side of the shaft adjacent the top end of the shaft; the grip strut extends from the upper shaft segment in a direction that is away from the drag side of the upper shaft segment and that is about one-hundred and fifty degrees from a longitudinal axis of the upper shaft segment; and, the lower shaft segment extends from the grip strut in a direction that is away from the shear side of the upper shaft segment and that is about one-hundred and fifty degrees from the longitudinal axis of the upper shaft segment.

8. The ergonomic canoe paddle of claim 7, wherein the right and left grip stems extend away from the shaft in a direction that is both about twenty degrees from a plane perpendicular to a longitudinal axis of the shaft adjacent the top end of the shaft and that is also in a direction that is about sixty-five degrees from the plane extending between opposed right and left edges of the blade and the top end of the shaft.

9. The ergonomic canoe paddle of claim 8, wherein the blade includes a slight curvature so that a tip of the blade extends in a direction away from the drag surface of the blade.

10. The ergonomic canoe paddle of claim 6, wherein the shaft includes an upper shaft grip support extension extending between the upper and lower shaft segments that is in about parallel alignment with a longitudinal axis of the upper shaft segment.

11. An ergonomic canoe paddle for propelling a light watercraft through water, comprising:

a. a shaft having a shear side and an opposed drag side;

b. a blade having a shear surface and an opposed drag surface secured to a bottom end of the shaft, so that the shear surface of the blade is secured to the shear side of the shaft and the drag surface of the blade is secured to the drag side of the shaft; and, c. a handle secured to a top end of the shaft, the handle including a central grip bar secured to the top end of the shaft, a right grip stem and a left grip stem secured to opposed ends of the central grip bar, wherein the right and left grip stems extend in a direction that is both away from the shaft and that is also away from the drag side of the shaft about sixty-five degrees from a plane defined as extending between opposed right and left edges of the blade and the top end of the shaft, so that when the left or right grip stem receives a user's hand grip the shear surface of the blade is disposed in an angular alignment that compensates for non-linear thrust as the shear surface of the blade shears the water to propel the watercraft.

12. The ergonomic canoe paddle of claim 11, wherein the right and left grip stems extend away from the shaft in a direction that is both about twenty degrees from a plane perpendicular to a longitudinal axis of the shaft adjacent the top end of the shaft.

13. The ergonomic canoe paddle of claim 12, wherein the shaft includes an upper shaft segment, a lower shaft segment, and a grip strut dimensioned to receive a user's hand grip secured between the upper and lower shaft segments; the upper shaft segment includes a shear side secured to the shear side of the shaft adjacent the top end of the shaft and the upper shaft segment includes a drag side secured to the drag side of the shaft adjacent the top end of the shaft; and, the grip strut extends from the upper shaft segment in a direction that is away from the drag side of the upper shaft segment and the lower shaft segment extends from the grip strut in a direction that is away from the shear side of the upper shaft segment.

14. The ergonomic canoe paddle of claim 13, wherein the grip strut extends in a direction that is away from the drag side of the upper shaft segment and that is about one-hundred and fifty degrees from a longitudinal axis of the upper shaft segment, and the lower shaft segment extends from the grip strut in a direction that is away from the shear side of the upper shaft segment and that is about one-hundred and fifty degrees from the longitudinal axis of the upper shaft segment.

15. The ergonomic canoe paddle of claim 14, wherein the blade includes a slight curvature so that a tip of the blade extends in a direction away from the drag surface of the blade.

16. The ergonomic canoe paddle of claim 15, wherein the shaft includes an upper shaft grip support extension extending between the upper and lower shaft segments that is in about parallel alignment with a longitudinal axis of the upper shaft segment.

* * * * *